United States Patent [19]

Kirkpatrick et al.

[11] 4,329,907

[45] May 18, 1982

[54] GUN BOLT FOR HIGH RATE OF FIRE REVOLVING BATTERY GUNS

[75] Inventors: Robert G. Kirkpatrick, Shelburne; Ronald R. Snyder, Georgia; Lincoln L. Sibley, Jr., Burlington, all of Vt.

[73] Assignee: General Electric Company, Burlington, Vt.

[21] Appl. No.: 118,026

[22] Filed: Feb. 4, 1980

[51] Int. Cl.[3] ..... F41D 7/02

[52] U.S. Cl. ..... 89/12; 89/172; 89/185

[58] Field of Search ..... 89/12, 13 R, 172, 185

[56] References Cited

U.S. PATENT DOCUMENTS

| | | | |
|---|---|---|---|
| 125,563 | 4/1872 | Gatling | 89/12 |
| 2,595,128 | 7/1951 | Hoyt | 89/12 |
| 2,849,921 | 9/1958 | Otto | 89/12 |
| 3,611,866 | 10/1971 | Jacolucci | 89/12 |
| 3,611,871 | 10/1971 | Kirkpatrick et al. | 89/12 X |
| 3,766,821 | 10/1973 | Cozzy et al. | 89/12 |

OTHER PUBLICATIONS

Technical Report-ADTC-TR-73-66 (FIG. 14) "GAU-81A Gun System" Eglin AFB, Sep. 1973.

*Primary Examiner*—David H. Brown
*Attorney, Agent, or Firm*—Bailin L. Kuch

[57] ABSTRACT

A feature of this invention is the provision of a gun bolt for a Gatling type gun having a carriage with a head journaled therein and a firing pin journaled in said head together with a cocking pin disposed in a slot passing through the firing pin, the head and the carriage with a detent disposed in a longitudinal bore of said head aft of said firing pin and having a portion thereof extending forwardly through a longitudinally extending bore in said firing pin and into a cavity in said cocking pin with a spring means disposed in said longitudinal bore of said head aft of said detent and biasing said detent into engagement with said cocking pin.

4 Claims, 2 Drawing Figures

GUN BOLT FOR HIGH RATE OF FIRE REVOLVING BATTERY GUNS

BACKGROUND OF THE INVENTION

1. Field of Art.

This invention relates to a gun bolt having an oscillating head for a Gatling type gun.

2. Prior Art.

The classic modern revolving battery gun, as shown by R. J. Gatling in U.S. Pat. No. 125,563, issued Apr. 9, 1872, held its gun bolts in their locked disposition by means of the main helical cam. An oscillating bolt head having interrupted threads was introduced by H. McC. Otto in U.S. Pat. No. 2,849,921, issued Sept. 2, 1958. The M61A1 Vulcan 20 mm gun does not have an oscillating bolt head, it utilizes a pivoting lock bolt. The 7.62 mm Minigun as exemplified in U.S. Pat. No. 3,595,128, issued to J. P. Hoyt, Jr. on July 27, 1971 has an oscillating bolt head. The gun shown in U.S. Pat. No. 3,611,871 issued to R. G. Kirkpatrick et al. on Oct. 12, 1971 has a head on a body which reciprocates in a splined tube, and which tube is oscillated. The gun shown in U.S. Pat. No. 3,766,821, issued to T. W. Cozzy et al. on Oct. 23, 1973 has a fully rotating collar on a non-rotating bolt head. The GAU-8/A 30 mm gun described in Technical Report ADTC-TR-73-66 dated September 1973, has a gun bolt with an oscillating head, shown in FIG. 14. In this bolt assembly, shown in FIG. 1, the cocking pin 10 is retained in the firing pin 12 by a spring cross pin 14 inserted through the firing pin and the cocking pin, and this pin 14 must be removed to disassemble the assembly. Subsequently, a spring cross pin 16 which secures a headed pin 18 to the bolt carriage 20 must be removed, to permit the bolt head 22 to be rotated 90° within the bolt carriage, to permit the removal of a dowel pin 24 which secures a cam follower assembly 26 to the bolt head. The removal of these spring pins requires the use of a drift punch and a hammer.

SUMMARY OF THE INVENTION

It is an object of this invention to provide an improved gun bolt of the oscillating head type for a Gatling type gun requiring a minimum of tools and effort for disassembly.

A feature of this invention is the provison of a gun bolt for a Gatling type gun having a carriage with a head journaled therein and a firing pin journaled in said head together with a cocking pin disposed in a slot passing through the firing pin, the head and the carriage with a detent disposed in a longitudinal bore of said head aft of said firing pin and having a portion thereof extending forwardly through a longitudinally extending bore in said firing pin and into a cavity in said cocking pin with a spring means disposed in said longitudinal bore of said head aft of said detent and biasing said detent into engagement with said cocking pin.

BRIEF DESCRIPTION OF THE DRAWING

These and other objects, features and advantages of the invention will be apparent from the following specification thereof taken in conjunction with the accompanying drawing in which.

DESCRIPTION OF THE PREFERRED EMBODIMENT

Figure 1:
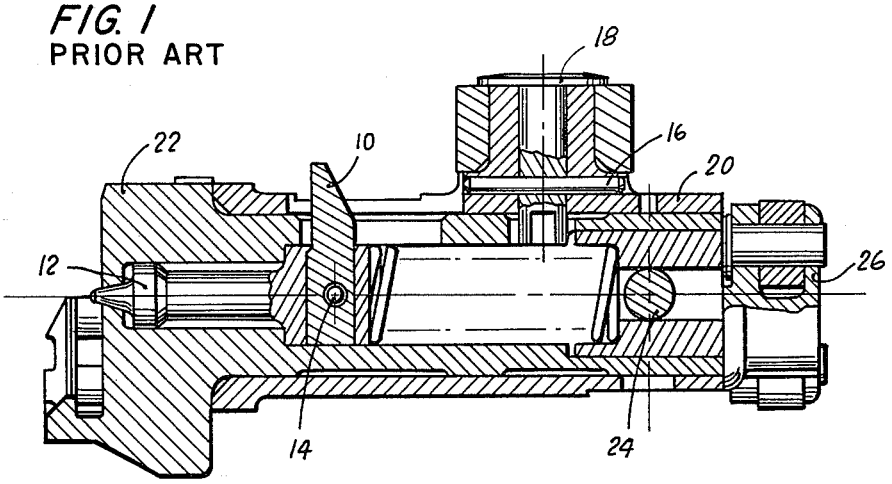
FIG. 1 PRIOR ART
FIG. 1 is a longitudinal cross-section of a gun bolt used in the GAU-8/A gun.
Figure 2:
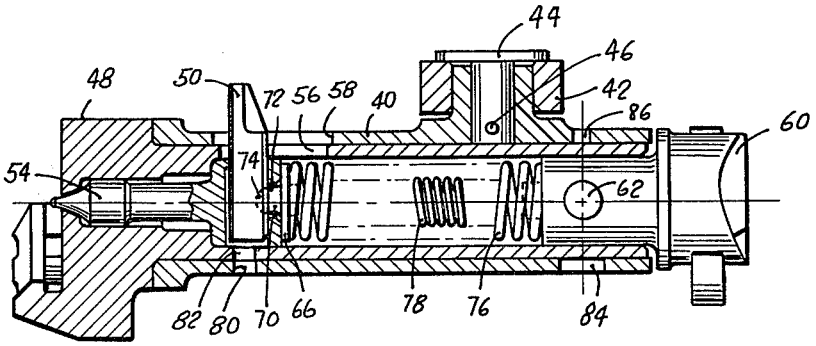
FIG. 2 is a longitudinal cross-section of a gun bolt embodying this invention.

As seen in FIG. 2, the gun bolt assembly includes a bolt carriage 40 having a cam roller 42 captured thereto by a headed pin 44 which is fixed by a spring pin 46. A bolt head 48 is captured within the carriage 40 by a cocking pin 50 which passes through a slot in a firing pin 54 which is disposed in a bore in the bolt head, through a wide slot 56 in the bolt head, and through a narrow slot 58 in the bolt carriage. The bolt head is further captured in the bolt carriage by a locking cam follower assembly 60 which is secured to the bolt head by a dowel pin 62. The cocking pin is captured in the firing pin by a detent including a medial disk portion 66, an aft boss portion and a forward portion 70 having a rounded nose. The nose passes through a longitudinal bore 72 in the firing pin and into a concave recess 74 into the aft side of the cocking pin. The detent is biased forwardly against the firing pin by two helical compression springs 76 and 78 which serve as the firing pin spring. The bolt carriage has a radial bore 80 which is aligned with the base of the cocking pin. The bolt head, when in the locked angular orientation, also has a radial bore 82 which is aligned with the base of the cocking pin. For disassembly, the bolt needs merely to be rotated to its locked angular orientation and a punch to be inserted into the bores 80 and 82 and pushed against the base of the cocking pin to cam the nose 70 of the detent 66 out of cavity 74 to free the cocking pin. The bolt head needs then to be rotated 90° to align the dowel pin 62 with two bores 84 and 86 in the bolt carriage and a punch to be inserted into the bore 86.

We claim:

1. A gun bolt for a Gatling type gun including:

a gun bolt carriage;

a gun bolt head journaled in a longitudinally extending bore in said carriage;

a firing pin journaled in a longitudinally extending bore in said gun bolt head;

a cocking pin disposed in a tranversely extending bore in said firing pin and extending through a transversely extending bore in said head and a transversely extending bore in said carriage;

a detent disposed in said longitudinal bore of said head aft of said firing pin and having a portion thereof extending forwardly through a longitudinally extending bore in said firing pin into a cavity in said cocking pin;

and spring means disposed in said longitudinal bore of said head aft of said detent and biasing said detent into engagement with said cocking pin.

2. A gun bolt according to claim 1 wherein:

said spring means serves as the firing pin spring.

3. A gun bolt according to claim 1 wherein:

said gun bolt head is journaled for oscillation about its longitudinal axis with respect to said carriage.

4. A gun bolt according to claim 1 wherein:

said carriage includes an additional transversely extending bore in diametral alignment with said cocking pin;

and said head includes an additional transversely extending bore in diametral alignment with said cocking pin.

* * * * *